United States Patent [19]

Kessler

[11] Patent Number: 4,768,666

[45] Date of Patent: Sep. 6, 1988

[54] TAMPER PROOF CONTAINER CLOSURE

[76] Inventor: Milton Kessler, 6690 Harrington Ave., Youngstown, Ohio 44512

[21] Appl. No.: 58,679

[22] Filed: May 26, 1987

[51] Int. Cl.[4] ..... B65D 41/34

[52] U.S. Cl. ..... 215/232; 215/252; 156/69

[58] Field of Search ..... 215/232, 252; 220/359; 156/69

[56] References Cited

U.S. PATENT DOCUMENTS

| | | | |
|---|---|---|---|
| 3,525,454 | 8/1970 | Frederiksen | 215/232 X |
| 3,788,509 | 1/1974 | Keeler | 215/232 |
| 3,851,783 | 12/1974 | Braginetz | 215/232 |
| 4,197,955 | 4/1980 | Luenser | 215/252 |
| 4,206,851 | 6/1980 | Ostrowsky | 215/252 X |
| 4,519,516 | 5/1985 | Amos | 215/252 |
| 4,658,976 | 4/1987 | Pohlenz | 215/252 |

*Primary Examiner*—Donald F. Norton

*Attorney, Agent, or Firm*—Browdy and Neimark

[57] ABSTRACT

A tamper-proof container has a screw threaded cap having a tear-away zone and a bottom radially extending flange welded to a radially extending flange of a screw threaded container.

8 Claims, 3 Drawing Sheets

TAMPER PROOF CONTAINER CLOSURE

Field of the Invention

The present invention relates to tamper-proof caps or closures of the tear-away strip type, primarily useful in conjunction with pharmaceutical containers for materials intended for consumption such as pharmaceuticals, and more particularly to a method and apparatus for ultrasonically or heat sealing such tamper-proof caps to container flanges, and the product produced therefrom.

BACKGROUND OF THE INVENTION

Due to the increasingly high occurrence of tampering with pharmaceutical containers and the like, particularly before purchase by the consumer, many attempts in recent years have been directed towards producing tamper-proof closures or caps which would signal or alert potential consumers that tampering or unauthorized access of the containers has transpired. The common use of incorporating tear-away strip caps have been increasingly employed; these caps, when opened, conveniently leave broken cap strips, thus very clearly alerting a customer to the fact that tampering of the closure has occurred.

It is known to weld or seal a portion of a cap directly to a part of a cap-abuttment or cap-seating flange or neck of the container to seal the cap to the container. When the cap is then removed, a portion below or adjacent the sealed portion may remain with the container while the remainder of the cap is removed. This allows for the cap, upon a hand turning force exerted thereon, to break off via for example a weakened portion, so that a portion of the cap becomes an integral non-removable portion of the container. For example, U.S. Pat. Nos. 3,525,454 to Fredericksen; 3,788,509 to Keeler; 3,851,783 to Braginetz; 4,011,961 to Widen et al; 4,207,988 to Provty et al; and 4,494,663 to Bertard et al all disclose tamper-proof caps or closures which are heat sealed or ultrasonically welded directly to the container flange or neck.

However, some of these above-mentioned patents require weld rings between the cap and the container to ensure a proper sealing of the cap and container when the heat sealing or ultrasonic generating apparatus are placed thereabout, thereby increasing the time and cost of manufacturing the sealed container. Furthermore, welding of the cap may only be completed in the internal regions where the cap abuts the container, thereby allowing the premature dislodgement of the cap from the container. Additionally, all of these prior art proposals require the necessity of large cumbersome apparatus to accomplish sealing of the cap to container, thereby providing slow and expensive production of the capped containers.

In the aforementioned Keeler USP, a spot welder is repeatedly reciprocated (see FIG. 3); this is not a practical solution, as it is too slow for commercial production. The aforementioned patents do not specify with sufficient particularity how to precisely obtain their seals, and furthermore such patents all relate to non-screw closures of particular and intricate construction which cannot be used in conjunction with the typical "top-hat" style screw cap. The same is true of the construction of the Fredericksen U.S. Pat. No. 3,525,454.

No tamper-proof screw cap or closure of the "top-hat" variety for use on pharmaceutical containers has previously been available which can be quickly and inexpensively sealed to a container. In addition, there is a great need for a tamper-proof cap of this type which can be sealed to a container flange wherein a large majority of the cap flange is ultrasonically or heat sealed to container flange with ease, simple equipment, quickly, inexpensively and with expediency while assuring a permanent and effective seal.

SUMMARY OF THE INVENTION

Accordingly, it is an object of the present invention to overcome the deficiencies of the prior art, such as those set forth above; and it is another object to provide for the improved sealing of tamper-proof screw caps to bottles.

It is still another object of the present invention to provide an improved tamper-proof container.

It is a further object of the present invention to provide an improved tamper-proof bottle with screw cap or closure sealed thereto.

It is yet another object of the present invention to provide a simple and inexpensive apparatus and method for heat sealing or ultrasonically sealing a tamper-proof cap to a container flange.

It is yet a further object of the present invention to provide an improved method and apparatus for either ultrasonically welding or heat sealing a tamper-proof cap of the screw "top-hat" style to a horizontal flange of a bottle.

It is still a further object of the present invention to provide a method and apparatus for producing a tamper-proof closure by ultrasonic or heat sealing from above to a container flange, quickly and inexpensively.

It is still another object of the present invention to provide a method and apparatus for ultrasonically or heat sealing a tamper-proof closure to a container flange which utilizes conveyor means for moveably positioning the container and cap adjacent a sealing station.

Still other objects, features and attendant advantages of the present invention will become apparent to those skilled in the art from a reading of the folloing detailed description of embodiments of the invention taken in conjunction with the accompanying drawings, wherein:

DESCRIPTION OF PREFERRED EMBODIMENT

Figure 1:
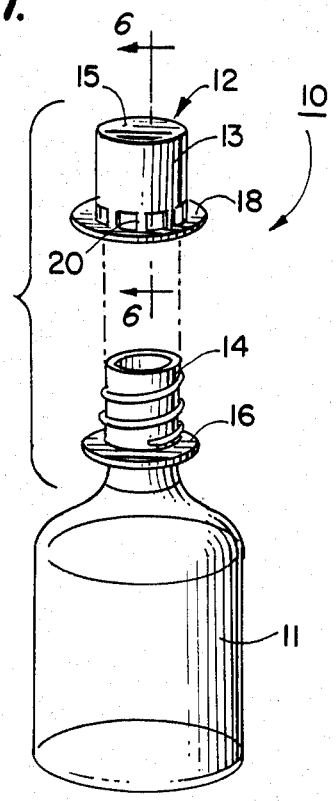
FIG. 1 is an exploded perspective view of an embodiment of a tamper-proof cap and container of the present invention.

The presently preferred embodiment of a cap according to the present invention is illustrated in FIGS. 1–4, 6 and 7 of the drawings. A sealed and tamper-proof container 10 according to the invention comprises a tamper-proof screw cap 12 ultrasonically or heat sealed to a horizontal flange 16 of a bottle 11. The sealing is accomplished at a sealing station 30 where a horizontal flange 18 of the cap 12 is sealed from above to a horizontal flange 16 of the bottle 11, and conveyor means 41 is used for transporting and positioning the bottle 11 adjacent to the sealing station 30.

The cap 12 is of the "top-hat" style having a substantially tubular side wall 13 with internal threading **12*a* and an open bottom and a closed top wall 15. The "top-hat" appearance is provided by an integrally formed planar annular flange 18 surrounding the circumference of the tubular wall 13 in a plane parallel to the cap top wall 15, the flange 18 simulating the brim of a top-hat. In actual practice, however, the width of the annular flange 18** may be much smaller in relation to the remainder of the cap as compared to what is shown in the drawings.

Figure 6:
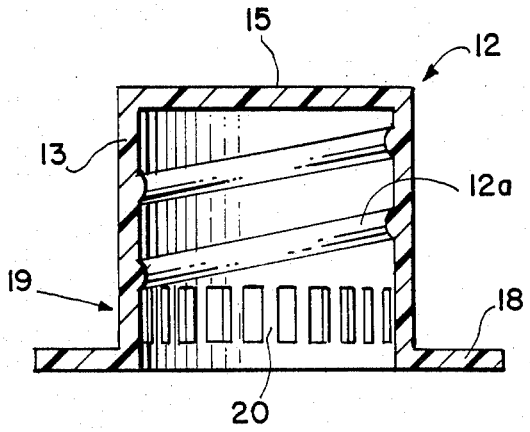
FIG. 6 is a cross-sectional view of the tamper-proof cap of the screw "top-hat" type of the present invention taken along line 6—6 in FIG. 1.

A plurality of equidistantly spaced-apart, integrally formed, tear-away strips 20 are formed in a band 19 about the circumference of the tubular wall 13 at a location just above the flange 18; it will be understood, however, that the tear-away portion 19 may take a form other than the illustrated strips 20, e.g. a perforated zone or any other sufficiently weakened construction to permit separation upon twisting. The internally threaded region **12*a* is provided above the region 19 of the tear strips 20 as best shown in FIG. 6 and is provided for facilitating the refastening of the cap 12 to the container after the tear-away strips 20 have been broken. While the thickness of the cap 12 as illustrated in FIG. 6 is exaggerated, it will be understood that the tear strip zone 19** may be molded somewhat thinner than the remainder of the cap.

The container 11, in the nature of a bottle, includes a substantially tubular open neck portion 14 externally threaded in the usual way. Located near the bottom of the neck portion 14 and below the threads is an integrally formed, planar annular flange 16, the flange extending outwardly from the neck generally in a plane perpendicular to the longitudinal axis of the bottle. It should be understood that the vertical distance between flange 16 and the container opening should be substantially equal to the vertical distance between the cap flange 18 and closed upper wall 15 of the cap 12.

Tamper-proof cap 12, as well as the container 11, should be formed of rigid or semi-rigid plastic materials which will not readily deform under handling forces and yet will permit the easy breaking of the frangible zone 19 when a normal hand turning force is applied to the cap. The material from which the bottle 11 and cap 12 are formed must also be heat sealable, or at least the flanges 16 and 18 must be formed of heat sealable material or at the very least coated with such a material. Suitable heat sealable materials are known and include polyethylene, polypropylene, PVC, styrene polymers and copolymers, polyesters such as polyethylene terephthalate, etc. The cap and bottle are formed to their predetermined shapes through the utilization of conventional molding methods such as blow molding for the bottle 11 and injection molding for the cap 12.

Figure 2:
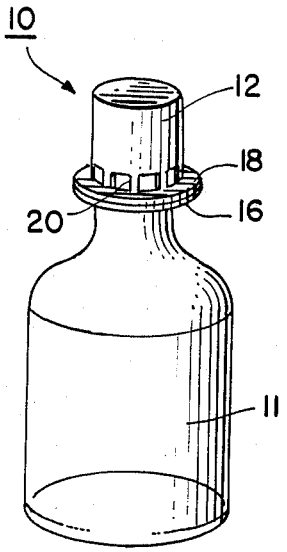
FIG. 2 is a perspective view of the container and tamper-proof cap sealed thereon.
Figure 3:
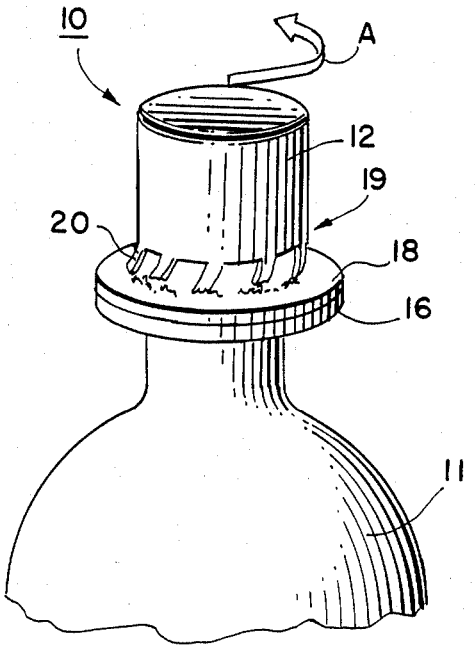
FIG. 3 is a partial perspective view of the tamper-proof cap/bottle showing removal of the cap to break the seal.

Referring now to FIGS. 2 and 3, the cap 12 is adapted to seat or abut the cap-abutting or seating flange 16 when sealed thereon, the cap flange 18 being in a position to abut and oppose the container flange 16 when fastened thereon. It should be understood that the cap-abutting flange 16 and the cap flange 18 desirably have equal diameters for purposes in preventing unauthorized cap removal by applying a vertical force to either flange directly normal to the planes of the flanges, such as with a sharp pointed object. As illustrated in FIG. 3, after sealing (described below) the cap 12 is removed and the seal is broken along the frangible zone 19 by merely rotating the cap 12 in the direction as indicated by arrow A thereby breaking the tear-away strips 20 thus permitting unscrewing of the cap and access to the contents of the bottle 11. It should also be understood that while the cap 12 may be removed upon breaking of the tear-away strips 20, flange 18 of the cap remains connected to the flange 16 of the container 11.

Figure 4:
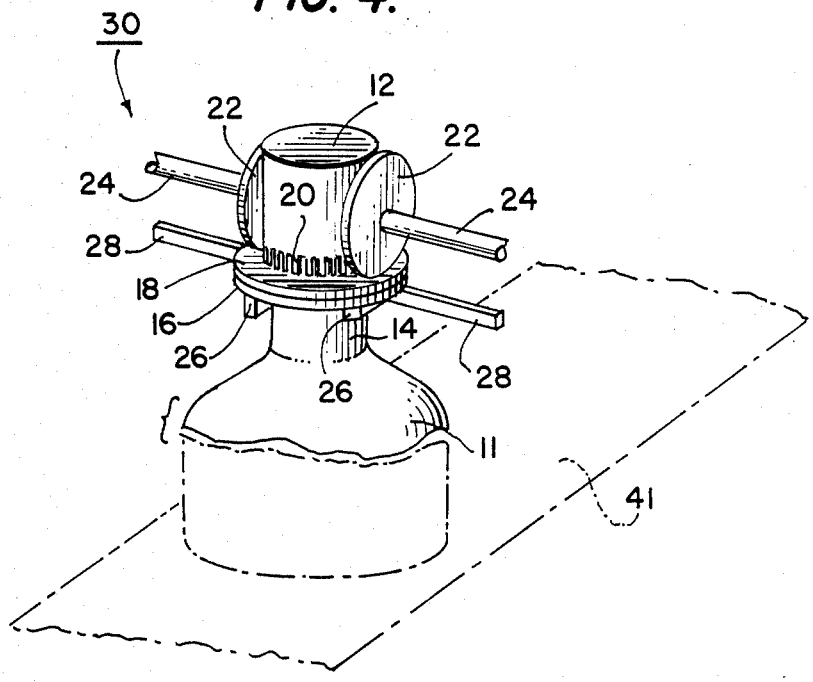
FIG. 4 is a partial perspective view of a simplified ultrasonic or heat sealing apparatus of the present invention, showing a conveying means transporting a single container and closure therefor to and at the sealing station.

Referring now to FIG. 4, the cap flange 18 may be welded and sealed either ultrasonically or by heat to the container flange 16 by passing both flanges, when abutted together, between sealing wheels 22,22 and underneath positioned sealing shoes 26,26, the sealing wheels and shoes contacting both flange surfaces normal to the plane of the flanges. The forward ends of the shoes 26,26 can be tapered or ramped to improve processing efficiency, or the shoes can be replaced by wheels so long as such wheels are sufficiently small to fit within the clearance space. Welding wheels 22,22 include axles 24,24 to permit rotation of the wheels, and the welding shoes 26,26 include supports or arms 28,28 to position the shoes adjacent and beneath the container flange 16.

As shown in FIG. 4, a single container 11, of a plurality of containers which require the sealing of their caps to their flanges, is transported or conveyed to a sealing station 30 by means of an endless belt conveyor 41 or the like. It should be understood that various other transporting or conveying means may be employed, such as hydraulically activated rams or the like. In a preferred embodiment, wheels 22,22 and shoes 26,26 produce weld strips 32,32 (see FIG. 4) tangent to the outer circumfererce of the cap on the surface of flange 18, as well as on the bottom surface of flange 16. Of course, the width of the weld strips 32 is dependent on the width of the wheels 22 and the shoes 26.

During the manufacturing and assembly of the containers, each container may be placed on the conveyor 41 which passes each container with its cap screwed thereon through the ultrasonic or heat sealing station 30 to perform welding of the cap flange 18 to the container flange 16 easily, inexpensively and quickly. It should be understood that, if desired, a second set of weld strips **32*a*,32*a* normal to weld lines 32,32** may be provided by simply reorientating, such as through the utilization of a hydraulic arm or the like (not shown), the containers 180° relative to their first position on the conveyor and then sealing a second time such as with a second set of welding wheels and shoes or the like.

Figure 5:
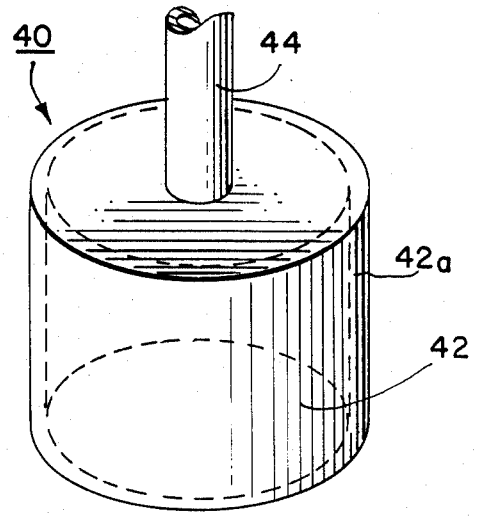
FIG. 5 is a partial perspective view of an alternate embodiment of an ultrasonic or heat sealing element for use in conjunction with the present invention.
Figure 7:
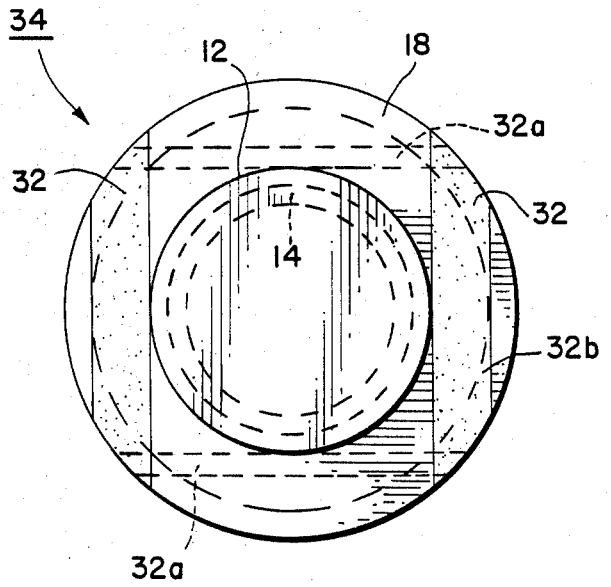
FIG. 7 is a plain view of the tamper-proof cap sealed or welded to the container flange, illustrating the weld lines produced thereon.

In an alternate embodiment shown in FIG. 5, the sealing station 40 may include a cylindrical cap shaped ultrasonic or heat sealing element 42 having a cylindrical outer wall **42*a*, the size and circumference thereof being such as to permit the element 42 to fit over the cap 12 to contact the cap flange 18 without otherwise contacting the cap, to produce an annular welding seam 32*b* (see FIG. 7). The cup-shaped sealing element 42 is supported to vertically reciprocate over each cap as the capped bottles 10 are passed therebeneath. With a single sealing element 42, the system operates cyclically rather than continuously; but the use of a plurality of such sealing elements 42** can provide a continuous sealing apparatus.

The sealing station provides complete welding of the flanges to assure proper bonding of the cap to the container flange 18. Thus, the sealing station 30, 40 is provided with conventional means (not shown) for activating or driving the welding wheels or shoes either ultrasonically or by induced heating of the wheels. Similarly, heat sealing or ultrasonic welding is effected using conventional means associated with the cup-shaped element 42. It should be understood that with respect to the system of FIG. 4 various other strategically placed weld lines may be produced by simply reorientating the position of the container prior to each passage of the container through the sealing station. It should also be understood that the present invention eliminates the usage of weld rings and complicated cumbersome welding or sealing apparatus.

It should be understood that various cap and necks, as well as flange dimensions may be employed to conform to receptacles or containers of varying sizes and circumferences, as long as the vertical distances between the container flanges and the container necks are substantially equal to the vertical distances between the cap flanges and the cap upper ends.

While the present invention is directed to tamper-proof closures or caps of the tear-away strip type especially for use in conjunction with pharmaceutical containers, it should be understood that the present invention is intended to encompass all types of tamper-proof closures or closures per se for use with containers which might employ a closure thereon to alert potential users of pre-tampering. The present description is directed to pharmaceutical containers employing tamper-proof closures of the tear-away strip type merely for purposes of exemplification and to illustrate one use of the present invention.

It will be obvious to those skilled in the art that various changes may be made without departing from the scope of the invention and the invention is not to be considered limited to what is shown in the drawings and described in the specification.

What is claimed is:

1. A tamper-proof container, particularly useful for holding pharmaceutical products, comprising:

a tamper-proof internally threaded tubular cap having a side wall defining a circular cylinder, a closed upper end and an open bottom end, and a central axis, said bottom end including an integrally formed annular cap flange radially extending outwardly in a plane normal to said central axis;

a cylindrical tear-away zone integrally formed about the periphery of said tubular cap and lying along the circular cylinder of said side wall and unitary therewith;

a container having a longitudinal axis, and an externally threaded neck portion having an open upper end, said neck including an integrally formed annular cap-abutting neck flange radially extending outwardly from said neck in a plane normal to said longitudinal axis and at a vertical distance from said opening no greater than the vertical distance between said cap flange and said closed upper end of said cap, and seal means comprising at least one weld between said cap flange and said cap-abutting neck flange integrally securing said cap flange to said cap-abutting neck flange.

2. A tamper-proof container in accordance with claim 1, wherein said flanges have substantially equal diameters.

3. A tamper-proof container in accordance with claim 1 wherein said weld is in the form of an elongated weld seam.

4. A tamper-proof container in accordance with claim 3, wherein said weld seam extends annularly around said flanges.

5. A tamper-proof container, particularly useful for holding pharmaceutical products, comprising:

a tamper-proof internally threaded tubular cap having a closed upper end and an open bottom end, and a central axis, said bottom end including an integrally formed annular cap flange radially extending outwardly in a plane normal to said central axis;

a tear-away zone integrally formed about the periphery of said tubular cap just above said annular cap flange;

a container having a longitudinal axis, and an externally threaded neck portion having an open upper end, said neck including an integrally formed annular cap-abutting neck flange radially extending outwardly from said neck and at a vertical distance from said opening no greater than the vertical distance between said cap flange and said closed upper end of said cap, and seal means for integrally securing said cap flange to said cap-abutting neck flange, said seal means comprising a plurality of welded connecting zones along facing surfaces of said cap flange and cap-abutting neck flange.

6. A tamper-proof container, particularly useful for holding pharmaceutical products, comprising:

a tamper-proof internally threaded tubular cap having a closed upper end and an open bottom end, and a central axis, said bottom end including an integrally formed annular cap flange radially extending outwardly in a plane normal to said central axis;

a tear-away zone integrally formed about the periphery of said tubular cap just above said annular cap flange;

a container having a longitudinal axis, and an externally threaded neck portion having an open upper end, said neck including an integrally formed annular cap-abutting neck flange radially extending outwardly from said neck in a plane normal to said longitudinal axis and at a vertical distance from said opening no greater than the vertical distance between said cap flange and said closed upper end of said cap, and seal means comprising at least one non-circular horizontally extending weld between said cap flange and said cap-abutting neck flange and integrally securing said cap flange to said cap-abutting neck flange.

7. A tamper-proof container particularly useful for holding pharmaceutical products, comprising:

a tamper-proof internally threaded tubular cap having a closed upper end and an open bottom end, and a central axis, said bottom end including an integrally formed annular cap flange radially extending outwardly in a plane normal to said central axis;

a tear-away zone integrally formed about the periphery of said tubular cap just above said annular cap flange;

a container having a longitudinal axis, and an externally threaded neck portion having an open upper end, said neck including an integrally formed annular cap-abutting neck flange radially extending outwardly from said neck in a plane normal to said longitudinal axis and at a vertical distance from said opening no greater than the vertical distance between said cap flange and said closed upper end of said cap, and seal means comprising at least one horizontally extending elongated weld seam extending across and between said cap flange and said cap-abutting neck flange in a horizontally extending plane parallel to said flanges integrally securing said cap flange to said cap-abutting neck flange, wherein said seal means comprise a plurality of straight weld seams.

8. A tamper-proof container particularly useful for holding pharmaceutical products, comprising:

a tamper-proof internally threaded tubular cap having a closed upper end and an open bottom end, and a central axis, said bottom end including an integrally formed annular cap flange radially extending outwardly in a plane normal to said central axis;

a tear-away zone integrally formed about the periphery of said tubular cap just above said annular cap flange;

a container having a longitudinal axis, and an externally threaded neck portion having an open upper end, said neck including an integrally formed annular cap-abutting neck flange radially extending outwardly from said neck in a plane normal to said longitudinal axis and at a vertical distance from said opening no greater than the vertical distance between said cap flange and said closed upper end of said cap, and seal means comprising at least one horizontally extending elongated weld seam extending across and between said cap flange and said cap-abutting neck flange in a horizontally extending plane parallel to said flanges integrally securing said cap flange to said cap-abutting neck flange, wherein said tear-away zone comprises a plurality of vertically aligned tear-away strips connecting said cap flange to said tubular cap.

* * * * *